US008566976B2

(12) United States Patent
Evans et al.

(10) Patent No.: US 8,566,976 B2
(45) Date of Patent: Oct. 29, 2013

(54) ADJUSTABLE DRAIN ASSEMBLY

(75) Inventors: Jesse R. Evans, Inman, SC (US); Bruce D. Niemitalo, Inman, SC (US)

(73) Assignee: Leveler Specifics, LLC, Inman, SC (US)

( * ) Notice: Subject to any disclaimer, the term of this patent is extended or adjusted under 35 U.S.C. 154(b) by 953 days.

(21) Appl. No.: 12/657,450

(22) Filed: Jan. 21, 2010

(65) Prior Publication Data

US 2011/0173747 A1 Jul. 21, 2011

(51) Int. Cl.
*E03C 1/12* (2006.01)

(52) U.S. Cl.
USPC ..... 4/679; 4/286; 4/613; 4/695; 285/261; 285/262

(58) Field of Classification Search
USPC ..... 4/286, 613, 679, 695; 285/261, 262
See application file for complete search history.

(56) References Cited

U.S. PATENT DOCUMENTS 4,879,771 A * 11/1989 Piskula ..... 4/286
6,269,495 B1 8/2001 Sondrup

* cited by examiner

*Primary Examiner* — Tuan N Nguyen
(74) *Attorney, Agent, or Firm* — McNair Law Firm, P.A.; Douglas W. Kim

(57) ABSTRACT

An adjustable drain assembly is provided. The assembly includes a base that has a concave inner pivoting surface and a top surface. An upper member is present and has a bottom surface located above the top surface. The upper member may have a concave inner pivoting surface. A pivot component may be present and have a convex outer pivoting surface that engages the concave inner pivoting surface of the base and upper member. The pivot component may be configured for engagement with a cover member. The base may have a pipe engagement surface for engagement with a pipe that is located completely below the pivot component.

17 Claims, 9 Drawing Sheets

ADJUSTABLE DRAIN ASSEMBLY

FIELD OF THE INVENTION

The present invention relates generally to an adjustable drain assembly. More particularly, the present application involves an adjustable drain assembly for use with waste water removal that can be adjusted so as to be flush with an upper surface of a floor for better drainage, appearance, and safety.

BACKGROUND

Floor drains are commonly found in locations such as bathrooms, basements, and showers for use in removing water that is either intentionally or unintentionally placed onto the surface that includes the floor drain. The drain generally includes a grate through which water and waste flows. An assembly attached to the grate is located below the floor and is itself attached to a pipe. The water and waste can flow through the grate and assembly and into the pipe for subsequent removal.

Plumbing codes generally require the pipe to be positioned at a certain angle so that water within the pipe may flow in the desired direction via gravity. The pipe usually takes the shape of an elbow at the drain location and placement of the pipe at the necessary angle thus causes the upper end of the pipe to be positioned at the same angle. Subsequent attachment of the grate and associated assembly to the pipe may cause the grate to be situated at an angle to the surface of the floor. A portion of the grate and/or assembly holding the grate may stick up from the surface of the floor or be located beneath the surface of the floor. Aside from creating an eyesore, this arrangement may present a tripping hazard to the occupants of the space or can cause damage by being snagged against shoes or socks.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
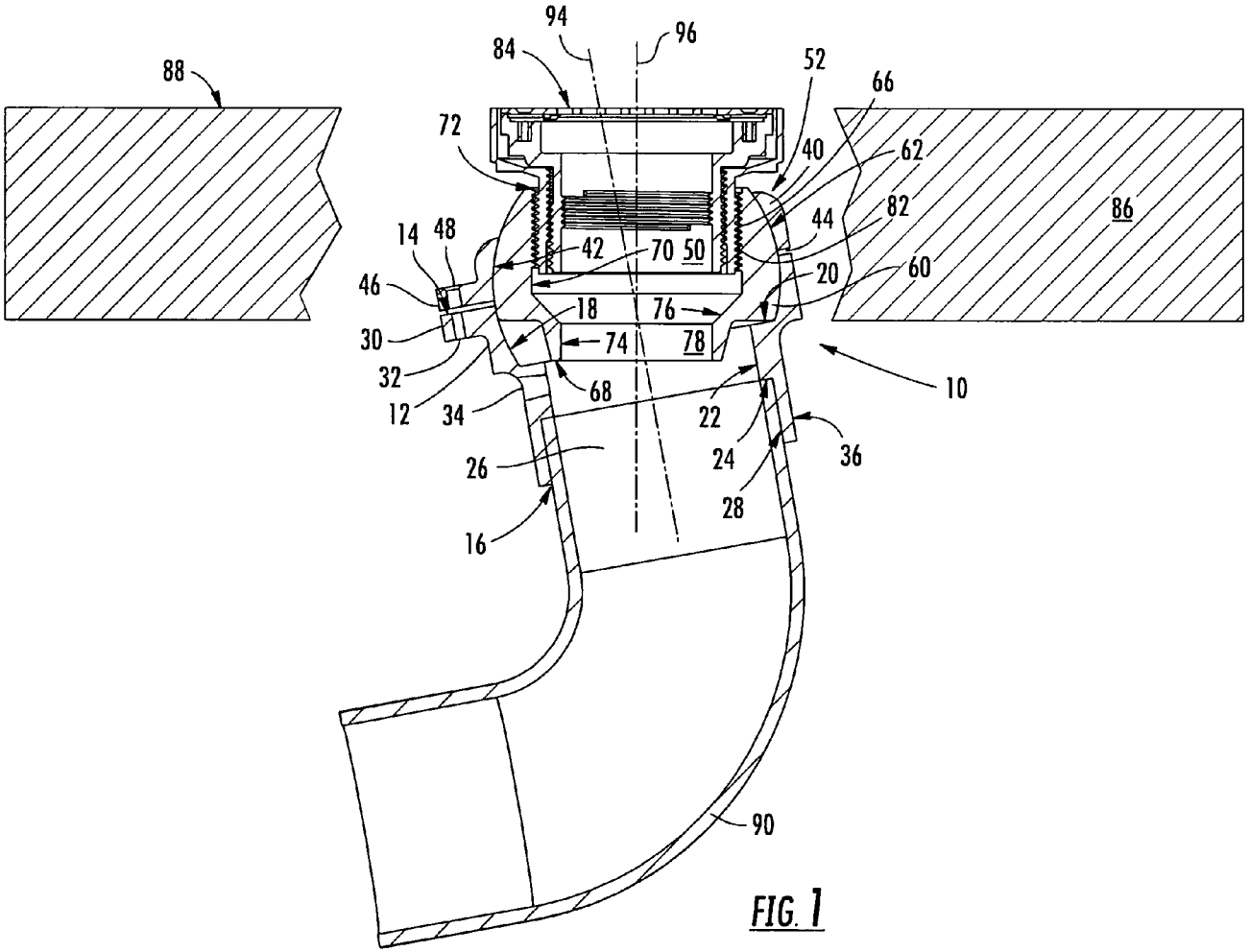
FIG. 1 is a cross-sectional view of an adjustable drain assembly shown in relation to a concrete floor in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an adjustable drain assembly 10 that can be used to align a grate 84 of a cover member 80 with the upper surface 88 of a concrete floor 86 to result in a safer and more visually pleasing arrangement. The adjustable drain assembly 10 may include a pivot component 60 housed within a base 12 and an upper member 40. The pivot component 60 may have a convex outer pivoting surface 62 that engages concave inner pivoting surfaces 18 and 42 of the base 12 and upper member 40 to allow the pivot component 60 to pivot with respect to the base 12 and upper member 40. The pivot component 60 can be adjusted so that the cover member 80 and grate 84 are moved to a desired position. A locking force may then be applied to the base 12 and upper member 40 to lock the position of the pivot component 60, and hence cover member 80 and grate 84, with respect to the base 12 and upper member 40.

FIG. 1 illustrates one exemplary embodiment of the adjustable drain assembly 10 shown in relation to a concrete floor 86. Installation of a drain into a floor of a residence or building may involve the placement of a pipe 90 at an angle to an upper surface 88 of a concrete floor 86 of the building. The pipe 90 may be placed at such an angle in order to ensure the flow of water through the pipe 90 for disposal. The adjustable drain assembly 10 facilitates an even placement of the cover member 80 with respect to the concrete floor 86 by including components that may be angled to one another. The pipe 90 may be rigidly connected to the bottom of a base 12. A pivot component 60 can be locked onto the base 12 and angled thereto. As shown, an axis 94 passing through the center of the base 12 is oriented at an angle to an axis 96 passing through the center of the pivot component 60. The cover member 80 can be attached to the pivot component 60 and can be properly positioned so that a grate 84 of the cover member 80 lays flush with the upper surface 88 of the concrete floor 86.

Figure 2:
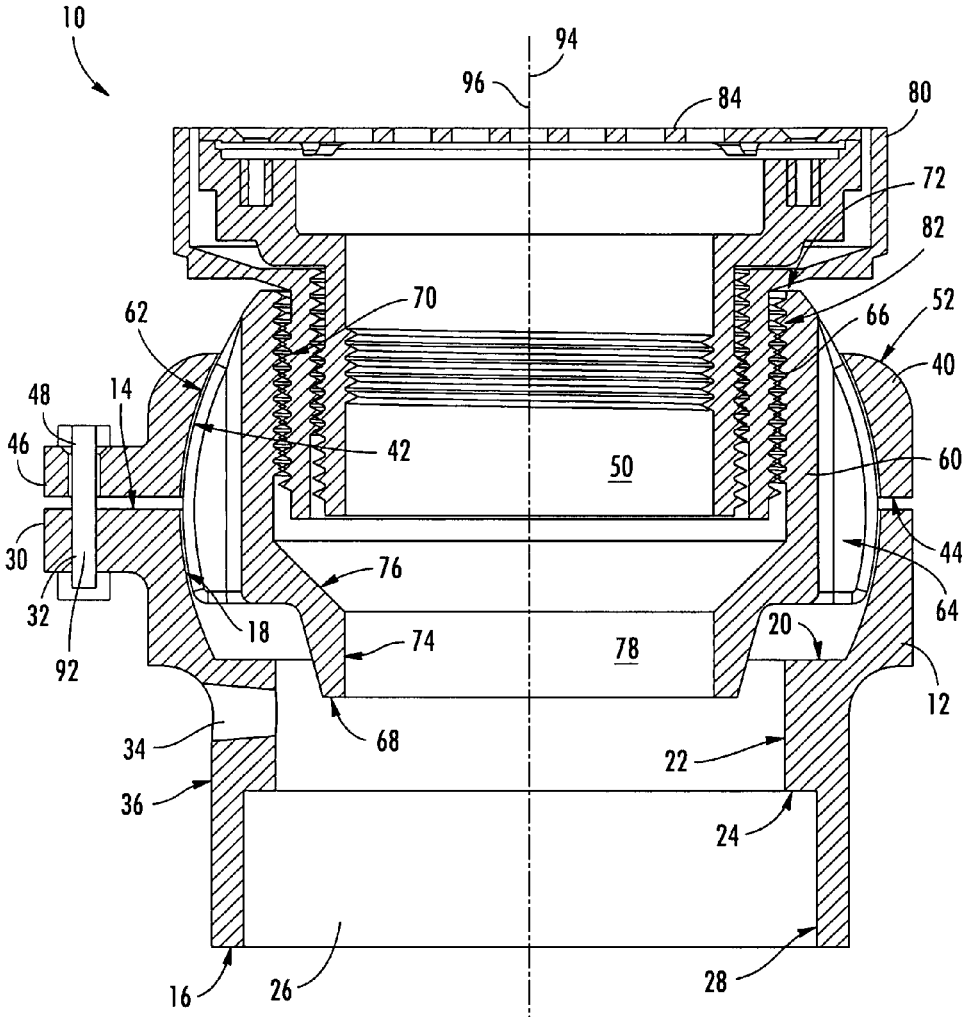
FIG. 2 is a cross-sectional view of an adjustable drain assembly in accordance with another exemplary embodiment.
Figure 5:
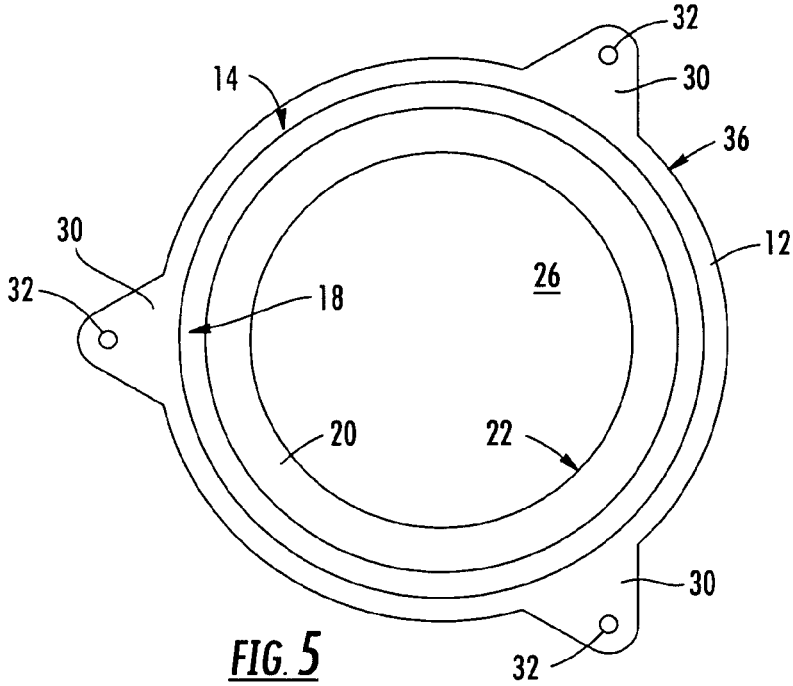
FIG. 5 is a top view of a base of an adjustable drain assembly in accordance with one exemplary embodiment.
Figure 6:
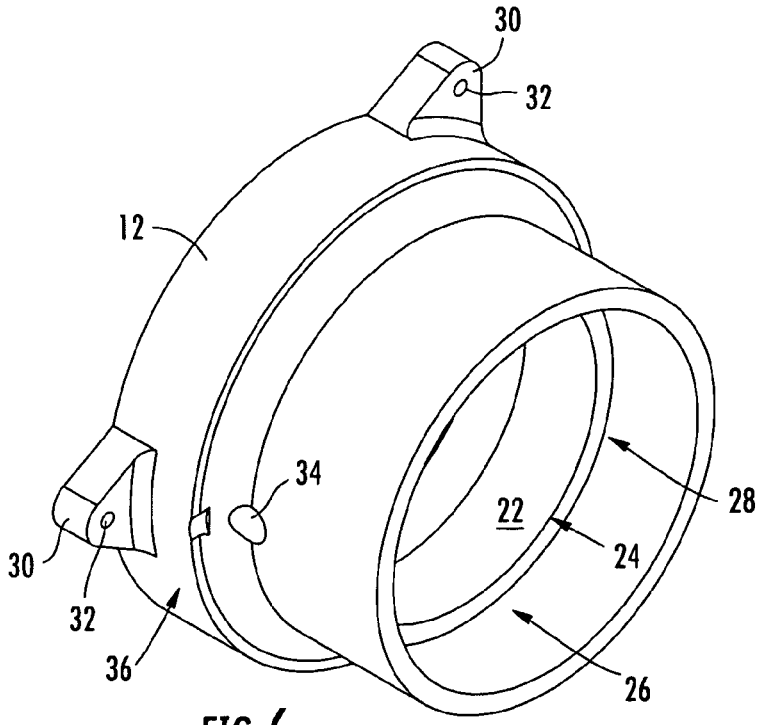
FIG. 6 is a perspective view of the base of FIG. 5.

An alternative exemplary embodiment of the adjustable drain assembly 10 is shown in FIG. 2. The drain assembly 10 includes a base 12, upper member 40, and pivot component 60. A cover member 80 can be attached to the pivot component 60. With reference now to FIGS. 2, 5 and 6, the base 12 defines a through bore 26 from a top surface 14 to a bottom surface 16. A concave inner pivoting surface 18 can extend from the top surface 14 and may define a portion of the through bore 26. The concave inner pivoting surface 18 can have a constant radius of curvature or may have a varying radius of curvature along its length. The concave inner pivoting surface 18 may be arranged so that the diameter of the portion of the through bore 26 formed by the concave inner pivoting surface 18 decreases in the direction extending away from the top surface 14 and at no point increases or remains the same along the entire length of the concave inner pivoting surface 18. The concave inner pivoting surface 18 may terminate at an upper step 20 that can extend in a direction perpendicular to an axis 94 extending through the base 12.

The base 12 may also include a pipe engagement surface 28 that can extend from the bottom surface 16. In some arrangements, the pipe engagement surface 28 may be located on the inside of the base 12 and form a portion of the through bore 26. In other embodiments, the pipe engagement surface 28 may be located along a portion of the outer side wall 36 of the base 12. In still other arrangements, the pipe engagement surface 28 may be located at the bottom surface 16 and need not extend along the inner wall or outer side wall 36 of the base 12. The pipe engagement surface 28 may be provided for engagement with the pipe 90, although it is to be understood that portions of the pipe engagement surface 28 need not contact the pipe 90 when the pipe 90 is attached to the base 12. However, in other arrangements, the entire pipe engagement surface 28 contacts the pipe 90 when the pipe 90 is attached to the base 12.

In the embodiment illustrated, the pipe engagement surface 28 extends from the bottom surface 16 and defines a portion of the through bore 26 that has a constant diameter. The pipe engagement surface 28 terminates at a lower step 24 that extends towards the axis 94 and causes the diameter of the through bore 26 to be reduced in size at the lower step 24. An inner surface 22 may extend from the lower step 24 to the upper step 20 and can be arranged so that it does not extend towards or away from the axis 94 and maintains the through bore 26 at a constant diameter. A flushing aperture 34 can extend from the outer side wall 36 of the base 12 to the through bore 26. The flushing aperture 34 can penetrate the outer side wall 36 at the inner surface 22 so as to extend through the inner surface 22. The flushing aperture 34 may be present in order to introduce water or other fluid into the drain assembly 10 and/or pipe 90. Non-use of the drain may result in water present within the drain to dry up, thus allowing sewage gases from the sewer system to revert back through the drain and into the building to which the drain is installed. Water may be inserted through the flushing aperture 34 to maintain a sufficient water level in a trap used to act as a buffer to sewage gases. However, it is to be understood that other arrangements of the adjustable drain assembly 10 may be provided that do not include a flushing aperture 34. Further, the flushing aperture 34 may be provided at a different location of the adjustable drain assembly 10 in other embodiments. In applications that do not involve water removal, a plug (not shown) may be inserted into the flushing aperture 34 to close off this opening if desired. Also, in applications involving the removal of waste water, the flushing aperture 34 can be unused if so desired and can be either closed off or left open.

The diameter of the through bore 26 may thus be varied along the length of the through bore 26 from the top surface 14 to the bottom surface 16. In other arrangements, the through bore 26 may be formed completely by the concave inner pivoting surface 18 and the other portions of the base 12 forming the through bore 26 as illustrated need not be present. In these arrangements, the through bore 26 may have a completely varying diameter along its entire length. The pipe 90 may be arranged so that it is completely below certain portions of the adjustable drain assembly 10 such as the pivot component 60, upper member 40, and the cover member 40. As such, no portion of the pivot component 60 may be capable of being inserted into the pipe 90 so as to be located within a through bore of the pipe 90. The attached adjustable drain assembly 10 forms an opening through which water or other waste material may flow through a grate 84 and through the interior of the adjustable drain assembly 10 and into the interior of the pipe 90 and then transported to a desired location. It is to be understood, however, that other arrangements are possible in which one or more of the components of the adjustable drain assembly 10 such as the pivot component 60, upper member 40, and/or cover member 80 are capable of being inserted into the pipe 90. As such, other arrangements are possible in which one or more of the components are not located completely above the pipe 90. In still other arrangements, the adjustable drain assembly 10 may be made so that the various components can touch the drain 90 but not be located within the drain 90.

Figure 12:
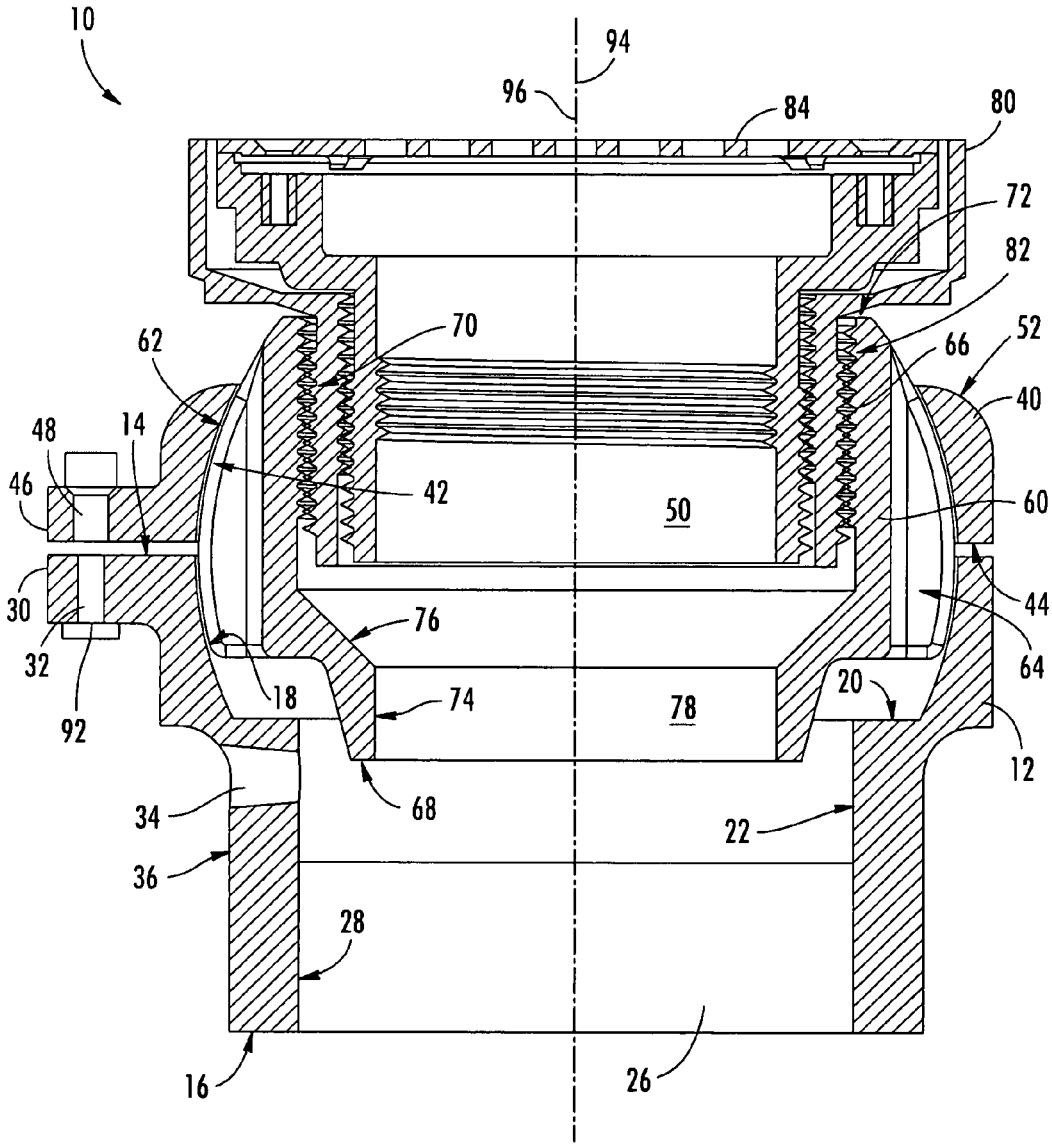
FIG. 12 is a cross-sectional view of an adjustable drain assembly in accordance with another exemplary embodiment.

FIG. 12 illustrates an alternative exemplary embodiment of the adjustable drain assembly 10 in which the base 12 includes a pipe engagement surface 28 that extends from the bottom surface 16. A portion of the through bore 26 is defined by the concave inner pivoting surface 18 that ends at an upper step 20 that extends in a direction perpendicular to the axis 94 of the base 12. The concave inner pivoting surface 18 and the upper step 20 may be arranged as previously described. The pipe engagement surface 28 defines a portion of the through bore 26 from the bottom surface 16 to the upper step 20 such that this portion of the through bore 26 has a constant diameter. As such, the lower step 24 and the inner surface 22 of the previously described embodiment are not present. The pipe 90 may be attached to the base 12 and can engage the entire length of the pipe engagement surface 28 or may engage only a portion of the length of the pipe engagement surface 28.

With reference now back to FIGS. 2, 5 and 6, the portion of the base 12 that defines the concave inner pivoting surface 18 may be integrally formed with the portion of the base 12 that defines the pipe engagement surface 28 so that these portions are a single piece. In this manner, the base 12 can be a single piece and not multiple pieces formed together that form the concave inner pivoting surface 18 and the pipe engagement surface 28. The portions of the base 12 as shown in the figures may be a single, integrally formed piece. However, other arrangements may exist in which multiple separate pieces are combined together so as to form the concave inner pivoting surface 18 and the pipe engagement surface 28 of the base 12.

The base 12 may include one or more flanges 30 positioned an equal distance about the perimeter of the base 12. Any number of flanges 30 may be included. For example from 1-3, from 2-5, or up to 10 flanges 30 may be present in other arrangements. As illustrated, three flanges 12 are present and each includes a flange aperture 32 extending therethrough. The flanges 30 and flange apertures 32 are used for engagement with an upper member 40 so that a locking bolt 92 can be disposed therethrough for use in providing a locking force to the adjustable drain assembly 10. However, other embodiments are possible in which flanges 30 and locking bolts 92 are not used to generate a locking force of the adjustable drain assembly 10. For example, set screws, a friction fit, mechanical fasteners, or interlocking components can be used to effect locking of the adjustable drain assembly 10.

Figure 9:
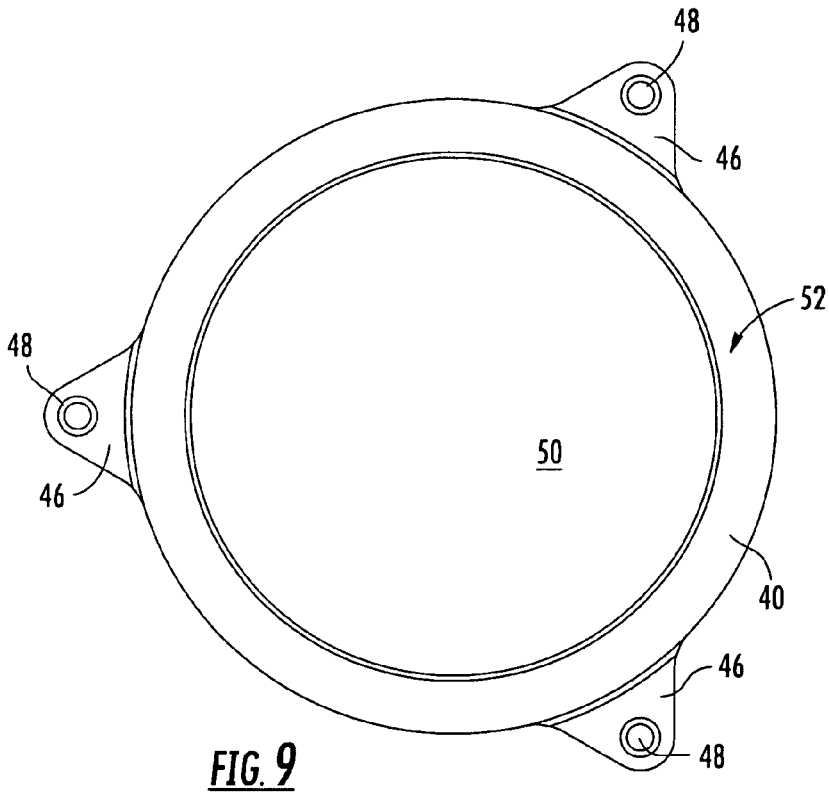
FIG. 9 is a top view of an upper member of an adjustable drain assembly in accordance with one exemplary embodiment.
Figure 10:
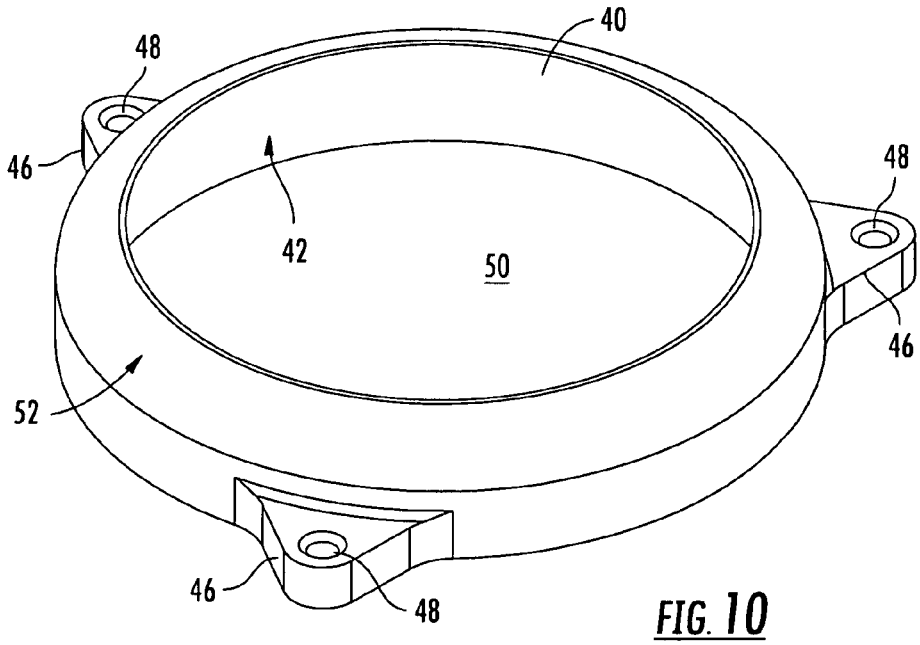
FIG. 10 is a perspective view of the upper member of FIG. 9.
Figure 11:
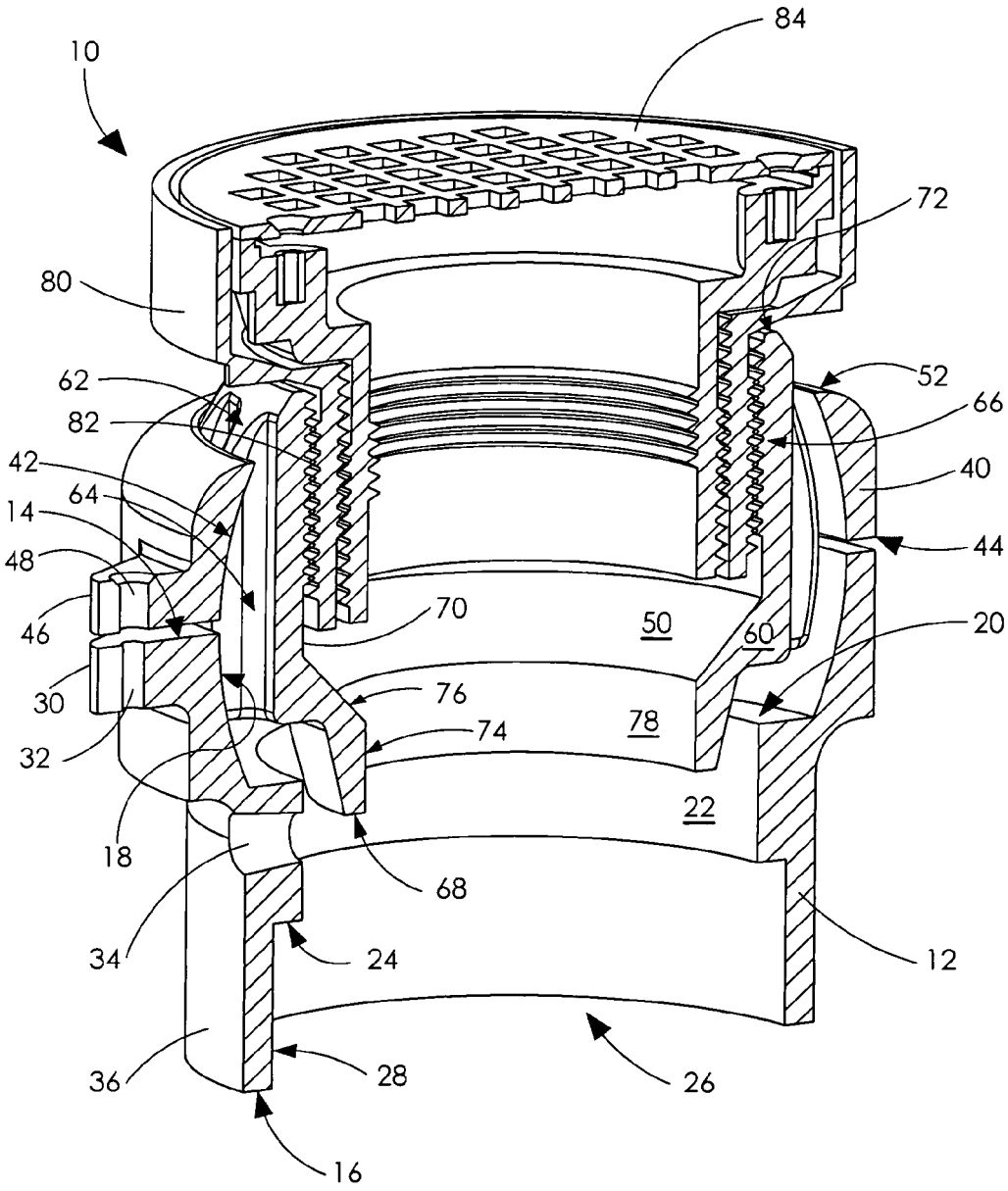
FIG. 11 is a cross-sectional view of the adjustable drain assembly shown in FIG. 2 without a locking bolt and rotated from the orientation shown in FIG. 2.

Referring now to FIGS. 2, 9 and 10, the adjustable drain assembly 10 includes an upper member 40 that has a bottom surface 44 that may directly face the top surface 14 of the base 12. The bottom surface 44 may be spaced from the top surface 14 or may in fact engage the top surface 14 in certain arrangements. The top surface 14 and bottom surface 44 may both be flat surfaces or may be variously shaped in other arrangements. The upper member 40 may include one or more flanges 46 that can coincide with the flanges 30 of the base 12. Any number of flanges 46 may be present in various arrangements such as from 1-3, from 2-5, or up to 10 flanges. The flanges 46 can each include a flange aperture 48 that align with respective flange apertures 32 of the flanges 30. A locking bolt 92 can be disposed through both the flange aperture 32 and the flange aperture 48 and tightened in order to urge the top surface 14 of the base 12 and the bottom surface 44 of the upper member 40 towards one another so as to effect locking of the adjustable drain assembly 10. As previously discussed, the use of flanges 46 and locking bolts 92 need not be present in other arrangements in order to effect locking of the adjustable drain assembly 10.

The upper member 40 defines a through bore 50 that extends from a top surface 52 to the bottom surface 44. The upper member 40 also has a concave inner pivoting surface 42 that may define the entire through bore 50. In other arrangements, the concave inner pivoting surface 42 may define only a portion of the through bore 50 and other portions of the upper member 40 can define the rest of the through bore 50. The concave inner pivoting surface 42 can be arranged so that the through bore 50 increases in diameter along the entire length of the through bore 50 from the top surface 52 to the bottom surface 44. In this regard, the concave inner pivoting surface 42 constantly changes along its entire length so that the through bore 50 does not have a constant diameter at any location. The radius of curvature of the concave inner pivoting surface 42 may be constant along its entire length, or various radii of curvature of the concave inner pivoting surface 42 may exist along its length. Further, the radius of curvature of the concave inner pivoting surface 42 may be the same as, or different from, the radius of curvature of the concave inner pivoting surface 18 of the base 12.

The upper member 40 can have a top surface 52 that is convex in shape. The top surface 52 can be differently shaped than the bottom surface 44, or may be the same shape as the bottom surface 44 in other embodiments. The top surface 52 can be arranged so that the upper member 40 cannot be flipped upside down so to make the top surface 52 directly face the top surface 14 of the base 12. However, other arrangements are possible in which the upper member 40 may be capable of being flipped upside down so as to face the top surface 14. For example, the top surface 52 need not be convex in shape but can have flat sections that extend around the entire circumference. In these alternate embodiments, the top surface 52 generally forms an apex in which a portion of the top surface 52 extends away from the concave inner pivoting surface 42. In other arrangements, the top surface 52 may be flat.

Figure 7:
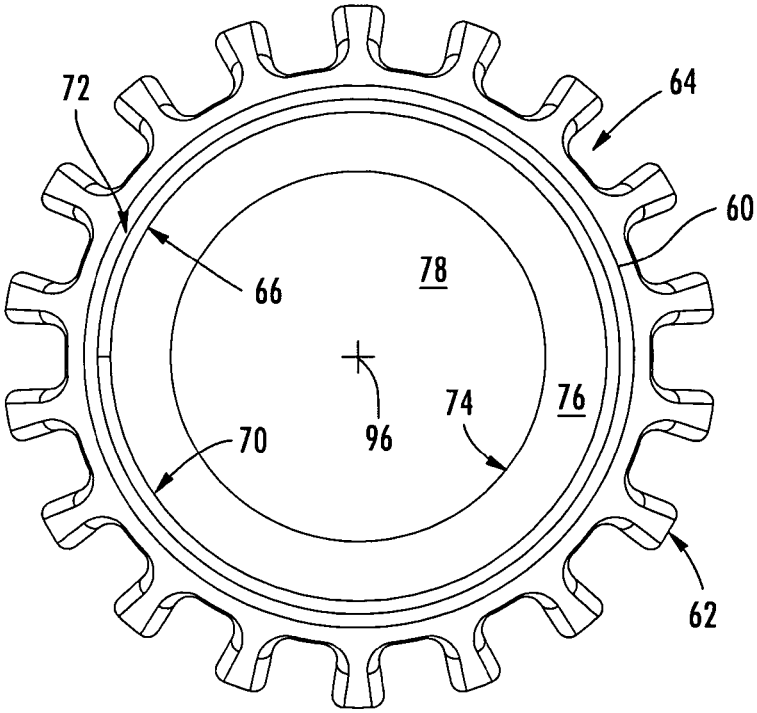
FIG. 7 is a top view of a pivot component of an adjustable drain assembly in accordance with one exemplary embodiment.
Figure 8:
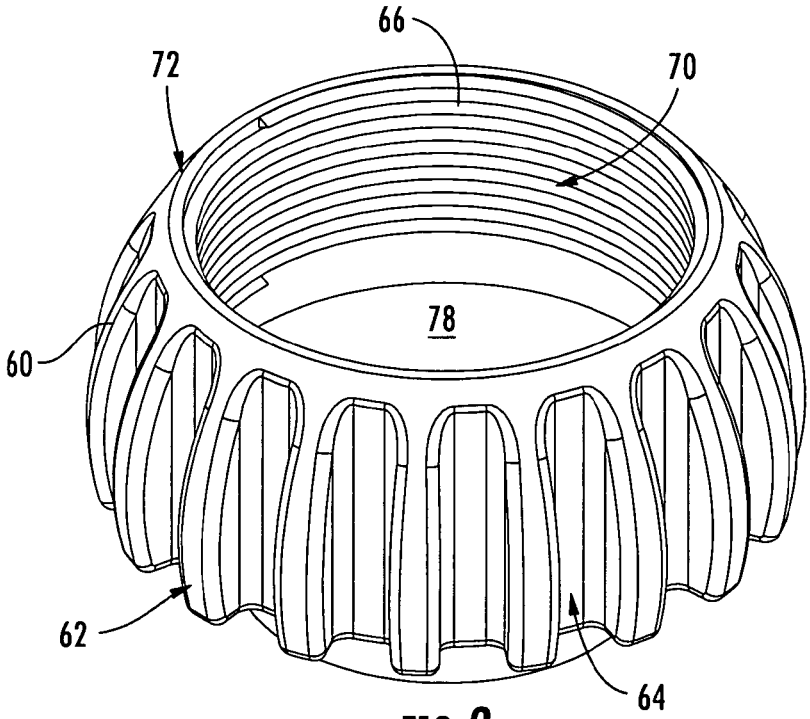
FIG. 8 is a perspective view of the pivot component of FIG. 7.

With reference now to FIGS. 2, 7 and 8, the adjusting drain assembly 10 includes a pivot component 60 that has a convex outer pivoting surface 62. A number of recesses 64 are defined in the convex outer pivoting surface 62 and extend generally along the length of the pivot component 60 so as to be roughly aligned with the axis 96 of the pivot component 60. The convex outer pivoting surface 62 may have a single, constant radius of curvature or may have varying radii of curvature in other exemplary embodiments. The radius of curvature of the convex outer pivoting surface 62 may be the same as the radii of curvature of the concave inner pivoting surfaces 18 and 42. As such, the convex outer pivoting surface 62 may be complimentary to the concave inner pivoting surfaces 18 and 42 so as to be capable of engaging these surfaces 18 and 42. The user may adjust the position of the pivot component 60 with respect to the upper member 40 and the base 12. The geometry of the pivot component 60 may function to limit the range of adjustment of the pivot component 60. For example, the portion of the pivot component 60 at the bottom of the convex outer pivoting surface 62 may extend inwards towards the axis 96 and may abut against the upper step 20 so as to prevent further pivoting of the pivot component 60. This may be illustrated with reference back to FIG. 1 in which the pivot component 60 abuts against the upper step 20. Also, as illustrated with reference to FIG. 1, the pivot component 60 need not have any recesses 64 located thereon. Although shown as extending completely around the axis 94 of the pivot component 60, in other arrangements the recesses 64 may extend up to 90°, up to 180°, or up to 270° around the convex outer pivoting surface 62 of the pivot component 60. The recesses 64 may function to reduce the weight of the pivot component 60 and hence reduce the cost of material in manufacturing this portion of the adjustable drain assembly 10.

Referring back to FIGS. 2, 7 and 8, the convex outer pivoting surface 62 extends completely around the outer circumference of the pivot component 60. In other arrangements, the convex outer pivoting surface 62 need not extend completely around the entire outer surface of the pivot component 60. In this regard, a portion of the outer surface of the pivot component 60 need not be convex in shape. The convex outer pivoting surface 62 may engage the concave inner pivoting surfaces 18 and 42 but can slide across these surfaces so that the angle of the axis 96 of the pivot component 60 can be adjusted relative to the axis 94 of the aligned base 12 and upper member 40. The engagement may also allow for the pivot component 60 to be able to be spun around on its axis 96 a complete 360°. Once the pivot component 60 has been oriented to a desired position relative to the base 12 and the upper member 40, the locking bolts 92 can be tightened in order to exert a force urging the base 12 and the upper member 40 towards one another. This force will be translated to the concave inner pivoting surfaces 18 and 42 that will be moved against the convex outer pivoting surface 62 in order to pin the convex outer pivoting surface 62 into the desired position. Repeated tightening of the locking bolts 92 will cause the convex outer pivoting surface 62 to be tightly engaged between the concave inner pivoting surfaces 28 and 42 and held securely into position.

The convex outer pivoting surface 62 extends from the top surface 72 of the pivot component 60 and terminates at a location above the bottom surface 68 so as not to extend all the way to the bottom surface 68. In other arrangements, the convex outer pivoting surface 62 can extend upwards from the bottom surface 68 and terminate at a location short of the top surface 72. In yet other exemplary embodiments, the convex outer pivoting surface 62 may extend the entire length from the top surface 72 to the bottom surface 68. The pivot component 60 defines a through bore 78 that extends from the top surface 72 to the bottom surface 68. A first inner surface 70 can extend from the top surface 72 and may form a portion of the through bore 78. The first inner surface 70 may have internal threading 66 defined thereon and, with the exception of the internal threading 66, can form a portion of the through bore 78 that has a constant diameter. A sloped surface 76 can extend from the bottom of the first inner surface 70 and may be directed so as to cause the portion of the through bore 78 formed by the sloped surface 76 to decrease in diameter in the direction extending away from the first inner surface 70 along the axis 96. The sloped surface 76 may have a constant degree of slope or may have various degrees in different embodiments. A second inner surface 74 may be defined from the bottom of the sloped surface 76 to the bottom surface 68 and can form a portion of the through bore 78 that has a constant diameter. The bottom surface 68 may be located in the portion of the through bore 26 formed by the inner surface 22 of the base 12. In other arrangements when pivoted, the bottom surface 68 may be located in the portions of the through bore 26 formed by both the inner surface 22 and the concave inner pivoting surface 18 of the base 12. For example, in an alternative arrangement of the adjustable drain assembly 10 the pivot component 60 includes a through bore 78 defined by a first inner surface 70 and a sloped surface 76 that extends from a top surface 72 to a bottom surface 68. The slope surface 76 can be arranged so that it extends from the bottom surface 68 to the first inner surface 70, and a second inner surface 74 need not be present.

Referring back to FIGS. 2, 7 and 8, the pivot component 60 may be arranged so that the pivot component 60 is located along the entire length of the through bore 50 of the upper member 40. Further, the pivot component 60 may extend along a portion of the length of the through bore 26 of the base 12. In other embodiments, the pivot component 60 may extend along the entire length of the through bore 26 of the base 12 and may extend along the entire length of the through bore 26 of the base 12. In yet further arrangements, the pivot component 60 may be located in and extend along the entire length of the through bore 26 of the base 12, and the pivot component 60 may be located in and extend through only a portion of the through bore 50 of the upper member 40 and not through the entire length of the through bore 50.

A cover member 80 can be attached to the pivot component 60 and can have an axis that aligns with the axis 96 of the pivot component 60 so that positioning of the pivot component 60 effects positioning of the cover member 80. The cover member 80 can be a separately purchased component or may be supplied with and form a part of the adjustable drain assembly 10 upon purchase. The cover member 80 may include a through bore and have external threading 82 that engages the complimentary internal threading 66 of the pivot component 60 so as to effect attachment. A grate 84 may be located at the top of the cover member 80. The user may turn the cover member 80 to move the cover member 80 due to the treaded connection between the cover member 80 and the pivot component 60. The height of the grate 84 may thus be raised and lowered with respect to the pivot component 60, upper member 40, and base 12. The cover member 80 illustrated in the exemplary embodiment includes a second set of threaded members that allows for additional adjustment of the height of the cover member 80 should the adjustments provided by the external threading 82 and internal threading 66 not be sufficient. The cover member 80 may be variously configured in accordance with different exemplary embodiments and a variety of types of cover members can be attached to the adjustable drain assembly 10. The cover member 80 may be a clean out or a cover plate in accordance with different exemplary embodiments.

One exemplary embodiment of the installation of the adjustable drain assembly 10 may first include the installation of the pipe 90 out of the ground at a desired drainage pitch angle. A string line may be placed that represents the final level of a cement floor 86 that is to be subsequently poured. The installer may place the adjustable drain assembly 10 onto the top of the pipe 90 and install same thereon. For example, the top of the pipe 90 may be press fit onto the pipe engagement surface 28. Other arrangements are possible in which the engagement between the pipe 90 and the base 12 may be effected through a threaded engagement, mechanical fasteners, or snap-in locking. Plumber's tape may be used to ensure this connection remains leak proof if desired. The installer can then adjust the angular orientation of the pivot component 60 and attached cover member 80 so that a grate 84 of the cover member 80 is level with the string line. The height of the cover member 80 with respect to the pivot component 60 can be adjusted as needed through the threaded engagement between internal threading 66 and external threading 82 so that the grate 84 is located at the sting line. Once the installer is satisfied with the position of the grate 84, he or she may tighten the locking bolts 92 so as to lock the angular orientation of the grate 84 and attached cover member 80 and pivot component 60. A water line may be attached to the flushing aperture 34 either before or after positioning of the grate 84 is accomplished.

Figure 3:
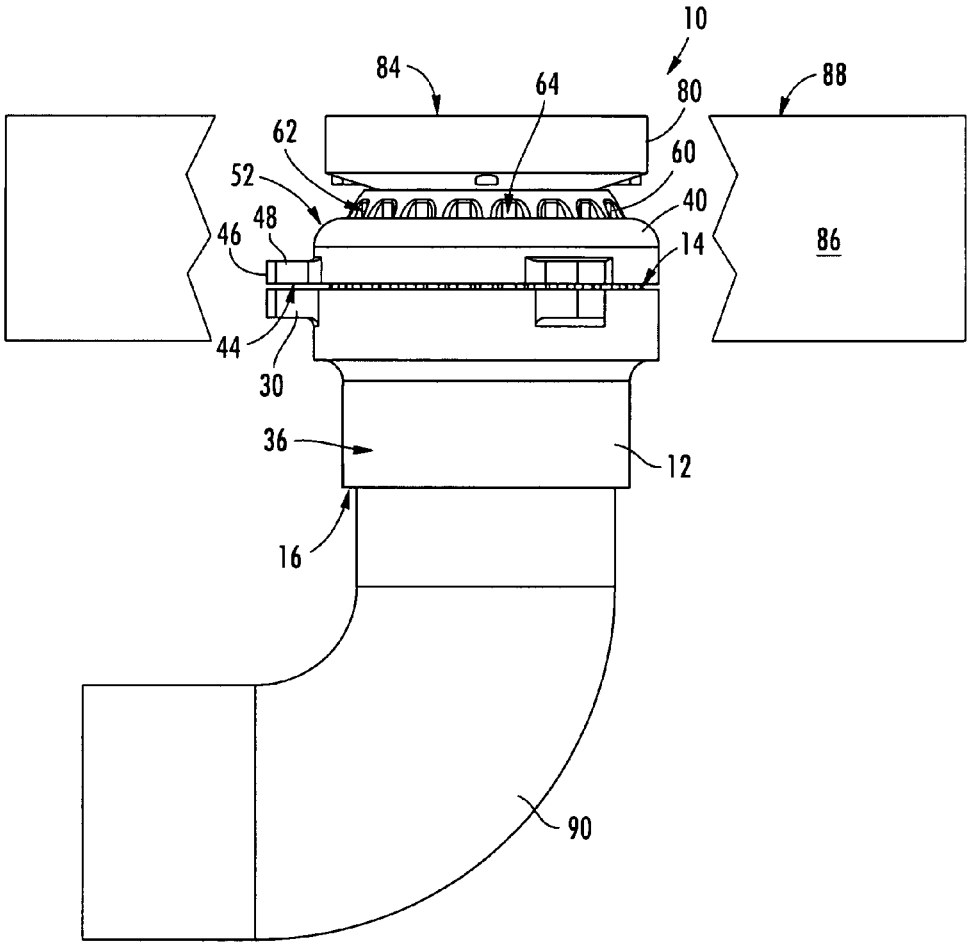
FIG. 3 is a side view of the adjustable drain assembly of FIG. 2 shown in relation to a concrete floor.
Figure 4:
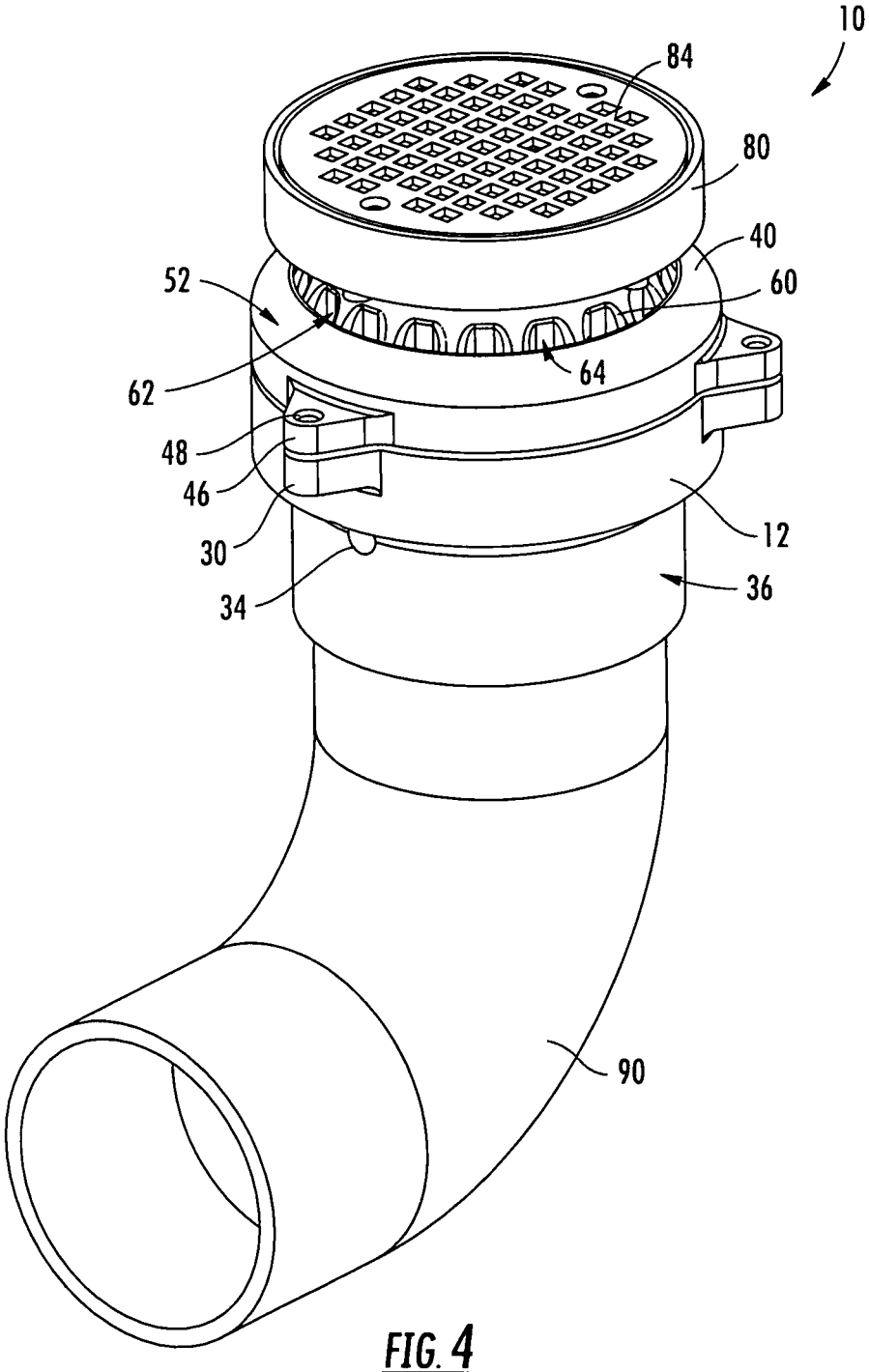
FIG. 4 is a perspective view of the adjustable drain assembly of FIG. 2 shown in relation to a pipe.

The concrete slab may be poured around the adjustable drain assembly 10 in order to form the concrete floor 86. The rigid interlocking of the adjustable drain assembly 10 will prevent this component and the attached grate 84 from being moved out of position when subjected to forces applied by the cement. FIG. 3 illustrates one exemplary embodiment in which recesses 64 are located on the pivot component 60. Concrete may enter the recesses 64 when poured to form the concrete floor 86. Hardening of concrete within the recesses 64 may further function to more securely anchor the adjustable drain assembly 10 into the concrete floor 86.

With reference now to the exemplary embodiment of FIG. 1, the adjustable drain assembly 10 is shown in relation to a concrete floor 86. As shown, the pivot component 60, cover member 80, and the grate 84 are pivoted in relation to the pipe 90, base 12 and upper member 40 so that the top of the grate 84 is flush with the upper surface 88 of the concrete floor 86. This positioning may eliminate the grate 84 or other portion of the cover member 80 as a tripping hazard since they are not flush with the upper surface 88. Also, this arrangement may prevent the accumulation of water or debris and resultant bacteria that will now go down the drain instead of being located outside of or at the grate 84 due to its positioning. Further, the arrangement may function to stabilize the line connected to the flushing aperture 34 as it may likewise be encased in concrete. The exemplary embodiment of FIG. 1 does not include recesses 64. However, the adjustable drain assembly 10 may still be securely held within the concrete floor 86 by having the concrete poured around the various components of the adjustable drain assembly 10. Further, although shown and described as being used in conjunction with a concrete floor 86, the adjustable drain assembly 10 may be used with other types of floors such as wood floors in accordance with other exemplary embodiments. Also, although described as being used in connection with water in a plumbing application, the adjustable drain assembly 10 may be used in other applications. For instance, the adjustable drain assembly 10 may be used in conjunction with an electrical conduit for use in housing electrical components such as wire or cable.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An adjustable drain assembly, comprising:

a base having a concave inner pivoting surface, wherein said base has a top surface;

an upper member having a bottom surface that is located above the top surface of the base, wherein the upper member has a concave inner pivoting surface; and a pivot component having a convex outer pivoting surface that engages the concave inner pivoting surface of the base and that engages the concave inner pivoting surface of the upper member, wherein the pivot component is configured for engagement with a cover member, wherein the base has a pipe engagement surface for engagement with a pipe wherein the pipe is located completely below the pivot component wherein an upper step extends from the concave inner pivoting surface of the base, and wherein the pipe engagement surface extends from a bottom surface of the base to the upper step, and wherein a bottom surface of the pivot component is located within a portion of a through bore of the base formed by the pipe engagement surface.

2. The adjustable drain assembly as set forth in claim 1, wherein a locking force is applied to urge the top surface of the base and the bottom surface of the upper member towards one another so as to effect a locking of the position of the pivot component with respect to the base and the upper member.

3. The adjustable drain assembly as set forth in claim 2, wherein the upper member has a flange with a flange aperture, and wherein the base has a flange with a flange aperture that is in alignment with the flange aperture of the upper member, and wherein a locking bolt is disposed through the aligned flange apertures and tightened so as to provide the locking force.

4. The adjustable drain assembly as set forth in claim 1, wherein the top surface of the base and the bottom surface of the upper member face one another and are spaced from one another.

5. The adjustable drain assembly as set forth in claim 1, wherein the convex outer pivoting surface has a plurality of recesses formed therein.

6. The adjustable drain assembly as set forth in claim 1, wherein the pivot component has internal threading defined thereon that is capable of engaging complimentary external threading of the cover member so as to effect attachment of the cover member to the pivot component and to allow the height of the cover member with respect to the pivot component to be adjusted.

7. The adjustable drain assembly as set forth in claim 1, wherein an upper step extends from the concave inner pivoting surface of the base, wherein the pipe engagement surface extends from a bottom surface of the base to a lower step, wherein an inner surface extends between the upper step and the lower step, and wherein a bottom surface of the pivot component is located within a portion of a through bore of the base formed by the inner surface.

8. The adjustable drain assembly as set forth in claim 1, wherein the base defines a flushing aperture that extends from an outer side wall of the base to a through bore of the base.

9. The adjustable drain assembly as set forth in claim 1, wherein the pivot component has a first inner surface that that extends from a top surface of the pivot component, wherein the pivot component has a second inner surface that extends from a bottom surface of the pivot component, wherein the pivot component has a sloped surface that extends from the first inner surface to the second inner surface, and wherein the second inner surface defines a portion of a through bore extending through the pivot component that has a smaller diameter than a portion of the through bore defined by the first inner surface.

10. An adjustable drain assembly, comprising:

a base having a concave inner pivoting surface that defines a portion of a through bore of the base, wherein the through bore of the base extends from a top surface of the base to a bottom surface of the base, wherein the concave inner pivoting surface extends from the top surface of the base to a location that is not at the bottom surface of the base, wherein the portion of the base defining the concave inner pivoting surface and the portion of the base defining the through bore from the concave inner pivoting surface to the bottom surface of the base are a single component;

an upper member that has a concave inner pivoting surface, wherein the upper member has a through bore; and a pivot component whose position can be adjusted relative to the base and the upper member, wherein the pivot component has a convex outer pivoting surface, wherein at least a portion of the pivot component is located in the through bore of the upper member, wherein the position of the pivot component can be adjusted relative to the base and the upper member to a desired position and then can be locked into place so as to have a fixed position relative to the base and the upper member wherein an upper step extends from the concave inner pivoting surface of the base, wherein the base has a pipe engagement surface that extends from the bottom surface of the base to a lower step that defines a portion of the through bore of the base and is configured for engagement with a pipe, wherein an inner surface extends between the upper step and the lower step, and wherein a bottom surface of the pivot component is located within a portion of a through bore of the base defined by the inner surface.

11. The adjustable drain assembly as set forth in claim 10, wherein in the locked position of the pivot component with respect to the base and the upper member the convex outer pivoting surface of the pivot component engages the concave inner pivoting surface of the base and engages the concave inner pivoting surface of the upper member, wherein the pivot component has a through bore and is configured for engagement with a cover member.

12. The adjustable drain assembly as set forth in claim 11, wherein the upper member has a flange with a flange aperture, and wherein the base has a flange with a flange aperture that is in alignment with the flange aperture of the upper member, and wherein a locking bolt is disposed through the aligned flange apertures and tightened so as to provide a locking force that urges the concave inner pivoting surfaces of the base and the upper member against the convex outer pivoting surface of the pivot component to lock the position of the pivot component with respect to the upper member and the base.

13. The adjustable drain assembly as set forth in claim 10, wherein the base has a pipe engagement surface for engagement with a pipe, and further comprising a pipe that is attached to the base and engages the pipe engagement surface, wherein the pipe is located completely below the pivot component.

14. The adjustable drain assembly as set forth in claim 10, wherein the upper member has a top surface that has a convex shape, and wherein the upper member has a bottom surface that is flat, and wherein the through bore of the upper member extends from the top surface of the upper member to the bottom surface of the upper member.

15. The adjustable drain assembly as set forth in claim 10, wherein the convex outer pivoting surface of the pivot component has a plurality of recesses formed therein.

16. The adjustable drain assembly as set forth in claim 10, further comprising a cover member that has external threading thereon, wherein the pivot component has internal threading defined thereon that is capable of engaging the complimentary external threading of the cover member so as to effect attachment of the cover member to the pivot component and to allow the height of the cover member with respect to the pivot component to be adjusted, wherein the base defines a flushing aperture that extends from an outer side wall of the base to the through bore of the base.

17. The adjustable drain assembly as set forth in claim 10, wherein the pivot component has a first inner surface that that extends from a top surface of the pivot component, wherein the pivot component has a second inner surface that extends from a bottom surface of the pivot component, wherein the pivot component has a sloped surface that extends from the first inner surface to the second inner surface, wherein the first inner surface and the second inner surface and the sloped surface define a through bore, and wherein the second inner surface defines a portion of the through bore of the pivot component that has a smaller diameter than a portion of the through bore defined by the first inner surface.

* * * * *